US005115793A

United States Patent [19]

Giaccardi et al.

[11] Patent Number: 5,115,793

[45] Date of Patent: May 26, 1992

[54] IGNITION DEVICE FOR INTERNAL COMBUSTION ENGINES, PARTICULARLY FOR DETECTING SPARK FAILURE

[75] Inventors: Eraldo Giaccardi; Alessandro Dassetto, both of Turin, Italy

[73] Assignee: Fiat Auto SpA, Turin, Italy

[21] Appl. No.: 704,506

[22] Filed: May 23, 1991

[30] Foreign Application Priority Data

May 23, 1990 [IT] Italy ..... 67376 A/90

[51] Int. Cl.[5] ..... F02P 5/155; F02P 11/00

[52] U.S. Cl. ..... 123/620; 123/643; 123/644

[58] Field of Search ..... 123/606, 607, 620, 643, 123/644

[56] References Cited

U.S. PATENT DOCUMENTS

| | | | |
|---|---|---|---|
| 4,438,751 | 3/1984 | Iwasaki | 123/643 X |
| 4,886,036 | 12/1989 | Johansson et al. | 123/643 X |
| 4,915,087 | 4/1990 | Boyer | 123/643 X |
| 4,938,200 | 7/1990 | Iwasaki | 123/620 |
| 5,009,213 | 4/1991 | Di Nunzio et al. | 123/620 DX |

FOREIGN PATENT DOCUMENTS

| | | |
|---|---|---|
| 0277468 | 8/1988 | European Pat. Off. . |
| 0305348 | 3/1989 | European Pat. Off. . |
| 0305349 | 3/1989 | European Pat. Off. . |
| 0323412 | 7/1989 | European Pat. Off. . |
| 0329099 | 8/1989 | European Pat. Off. . |
| 0383730 | 8/1990 | European Pat. Off. . |
| 2189840 | 11/1987 | United Kingdom . |
| 8706979 | 11/1987 | World Int. Prop. O. . |

*Primary Examiner*—Willis R. Wolfe

*Attorney, Agent, or Firm*—Sughrue, Mion, Zinn, Macpeak & Seas

[57] ABSTRACT

The device comprises a primary winding in which the spark energy is stored to be transferred rhythmically to a secondary winding with respective voltage step-up transformers acting between the secondary winding and the spark plugs. An amperometric resistor is arranged in series with the diode through which the current flows when the energy is transferred to the plugs. For each spark, there is a corresponding voltage peak across the terminals of the resistor, whereby a failure to detect the presence of the peak (which is usually converted into a square-wave signal) identifies the absence of a spark.

7 Claims, 2 Drawing Sheets

IGNITION DEVICE FOR INTERNAL COMBUSTION ENGINES, PARTICULARLY FOR DETECTING SPARK FAILURE

BACKGROUND OF THE INVENTION the present invention relates in general to ignition devices for internal combustion engines.

The application of anti-pollution regulations which have become progressively more stringent has led to a need to use ever more sophisticated ignition systems in cars with petrol engines so as to ensure that the air-fuel mixture burns properly even under the most difficult conditions. This is because of problems of controllability and driving convenience, as well as to ensure that the limits set by the regulations are respected and, above all, to avoid a rapid decline in the conversion efficiency of the catalytic converter which is very sensitive to the presence of unburnt products.

Despite the precautions adopted, however, sporadic spark failure may occur because of occasional malfunctioning of the electronics, faulty contacts in the wiring or the soiling of the plugs. Although this is often not noticed by the average motorist, it is very important to be able to diagnose the phenomenon immediately and provide a timely indication of the need for maintenance of the system.

Various systems have been proposed in the past for detecting spark failure (that is, the fact that a spark has not been struck in a particular plug).

For example, in ignition systems with individual coils for each plug, it is possible to arrange for the terminal of the secondary winding opposite the respective spark plug to be connected to the ignition control unit and earthed through a resistor instead of being connected to the respective primary winding. The arc (or spark) current is therefore earthed through the resistor and its passage causes a pulsed voltage which accurately reproduces the arc current and can be used for diagnostic purposes to detect spark failure.

This solution has various disadvantages, amongst which may be mentioned:

an increase in radio-frequency interference;

the need for more complex wiring with corresponding cost increments;

the need to provide additional terminals on the connectors of the ignition control unit, and an intrinsic danger of the solution in that, if perfect connections are not ensured between the various terminals involved, electrical discharges may arise which, in the worst cases, may even happen within the ignition control unit with the possibility of serious damage thereto.

In an equivalent solution, the detection resistor may be transferred outside the control unit. In this case, however, a further need arises to provide a system for mounting the resistor, whilst all the other disadvantages listed above remain.

The solution just described cannot be applied to so-called lost-spark systems since (as is known) a terminal of the high-tension winding is no longer available as both the terminals are connected solely to the two high-tension terminals of the two plugs served.

Spark failure can be detected with a certain degree of effectiveness, however, even with these arrangements. Such systems provide for the use of an ignition coil with a dual high-tension output for each pair of plugs. In this case, the diagnosis can be made by the application of a capacitive loop sensor to one of the high-tension outputs to detect the high-tension pulses sent to the plugs. A solution of this type is described, for example, in European patent application No. EP-A-0 277 468, assigned to the same Assignee as the present application.

Although advantageous, this solution is not without some disadvantages. Amongst these may be cited, for example:

the presence of fairly complex wiring (in the case of an engine with four cylinders, it is necessary to provide at least two return wires to the ignition control unit);

the additional cost (although quite low) of the loop sensor which could even be incorporated in the resin in the conduit of the coil but this would give rise to insulation problems;

a certain difficulty in the processing of the signals detected, and an increase in the interference emitted.

The present invention aims to resolve the problems mentioned above, preferably with the use of a circuit diagram of the type described in prior European patent application No. EP-A-0 383 730, assigned to the same Assignees as the present application.

The basic operating principles of this prior solution are shown in FIG. 1 of the appended drawings, which corresponds to FIG. 5 of the European application cited above.

In this drawing, the battery voltage, indicated VB, is used to charge the primary winding S1 of a coil B under the control of a Darlington transistor D with an associated Zener diode Dz for limiting the initial surge voltage. The coil B is constituted by a mutual impedance with a unitary or substantially unitary primary turns/-secondary turns ratio.

The secondary winding S2 of the coil B is connected to the primary windings of respective voltage step-up transformers without air gaps mounted directly on the spark plugs. Only one of these voltage step-up transformers (indicated T1 and associated with a spark plug SP1) is shown in the diagram of FIG. 1, the numbers of turns in the primary winding and in the secondary winding being N1 and N2 respectively.

The energisation of the transformers associated with the plugs (T1 in this case) is controlled by respective electronic switches (for example, the triac TR1 shown in the diagram) piloted so as to ensure the correct firing sequence.

A resistor R is connected in series with the secondary winding $S_1$ to limit the prepolarisation currents in the transformers associated with the plugs (T1) to a value of $+B_{max}$. A diode, indicated D1, short-circuits the resistor R during the transfer or energy to the plugs. A capacitor, indicated C, is connected between the collector and the emitter of the Darlington transistor to limit the value of dV/dt in the switch TR1 at the instant at which the Darlington transistor is switched (off).

The excitation of the Darlington transistor D and of the triac TR1 is controlled, according to known criteria, by a control unit.

The coil B has the function of storing the electromagnetic excitation energy $E=\frac{1}{2}LI^2$ in each cycle (a rotation of the engine through 180°)

The energy is then discharged, the conductivity of the Darlington transistor D being blocked, and, after the respective electronic switch TR1 has been closed, the energy is transferred by the corresponding transformer T1 to the plug SP1 in which the discharge (spark) is to occur.

The sequence of closing (making conductive) the triac (TR1) associated with each plug (SP1) is effected in such a manner that the respective voltage step-up transformer (T1) is activated only for a brief period after the instant at which the Darlington transistor D starts to conduct so as to prevent (or at least to reduce) the production of spurious peaks in the plugs during the prepolarisation stage.

The distinctive characteristic of the circuit of FIG. 1 lies in the fact that, during the charging stage, the auxiliary coil B enables the transformer (T1) of each plug to be prepolarised to $+B_{max}$ and, hence, with a flow opposite that which is applied during the discharge.

FIGS. 2*a* and 2*b* (which correspond to FIGS. 6*e* and 6*h* of the European Application No. EP-A-0 383 730) show the waveform of the current i circulating between the secondary winding of the coil B and the primary winding of the transformer T1 (or of any one of the other transformers associated with the plugs) during the transfer of the spark energy. The graph of FIG. 2*b*, however, shows typical changes in the arc current $i_{SP}$ induced in the respective plug (e.g. SP1).

In order to explain the time graph of the current i (which naturally is repeated cyclically for each spark, starting from a theoretical time 0 preceding the time at which the spark is to be produced by a given interval—selected according to known criteria which need not be repeated herein) the following is true.

Interval 0–t1 (the Darlington transistor D is conductive which results in an increase in the intensity of the current in the primary winding S1 to a maximum value at the moment t1 at which the Darlington transistor starts to be cut off):

in practice, the current i corresponds to the sum of the prepolarising current of T1 and the current lost in the core;

interval t1–t2 (the generation, due to the interruption of the current in the primary winding S1, of a high pre-spark voltage in the secondary winding N2, until it reaches the dielectric breakdown value at the moment t2);

the sign of i is reversed as a result of the reversal of the voltage VP across the terminals of the primary winding of the voltage step-up transformer T1;

interval t2–t3 (discharge):

in practice, the current i corresponds to the sum of the arc current, which is given by the turns ratio relative to the primary winding of T1, the magnetisation current, and the current lost in the core; the peak which can be seen at the moment t2 is caused by the discharge of the capacitor C through the primary winding of the auxiliary coil B when the arc is struck;

moment t3 (annulment of the discharge current—quenching of the arc):

the current i corresponds to the sum of the magnetisation current and the lost current and decreases slowly to reach 0 at the moment when the next triac (associated with another plug) is switched on.

SUMMARY OF THE INVENTION

More specifically, the present invention aims to enable spark failure to be detected extremely simply and easily in a circuit of the type illustrated in FIGS. 1, 2*a* and 2*b*, without the need for complex circuit components.

According to the present invention, this object is achieved by virtue of an ignition device having the characteristics recited specifically in the claims which follow.

BRIEF DESCRIPTION OF THE DRAWINGS

The invention will now be described, purely by way of non-limiting example, with reference to the appended drawings, in which.

DETAILED DESCRIPTION OF THE INVENTION

Figure 1:
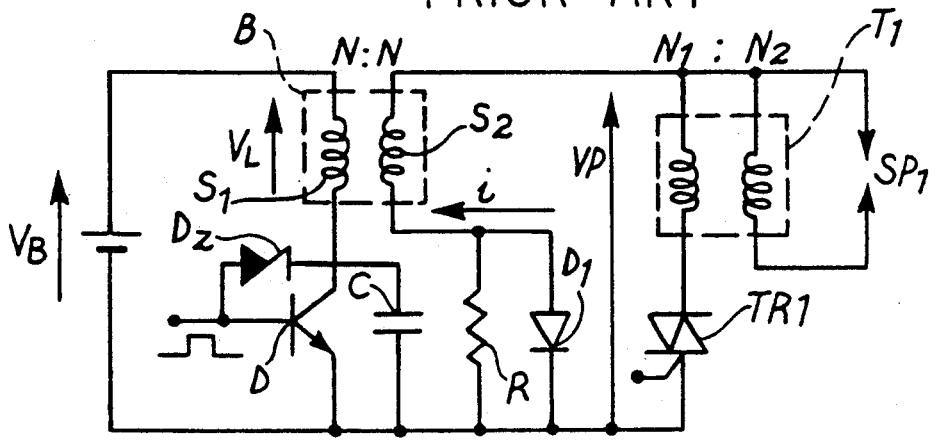
FIG. 1 PRIOR ART
FIGS. 1, 2*a* and 2*b* have already been described above.
Figure 3:
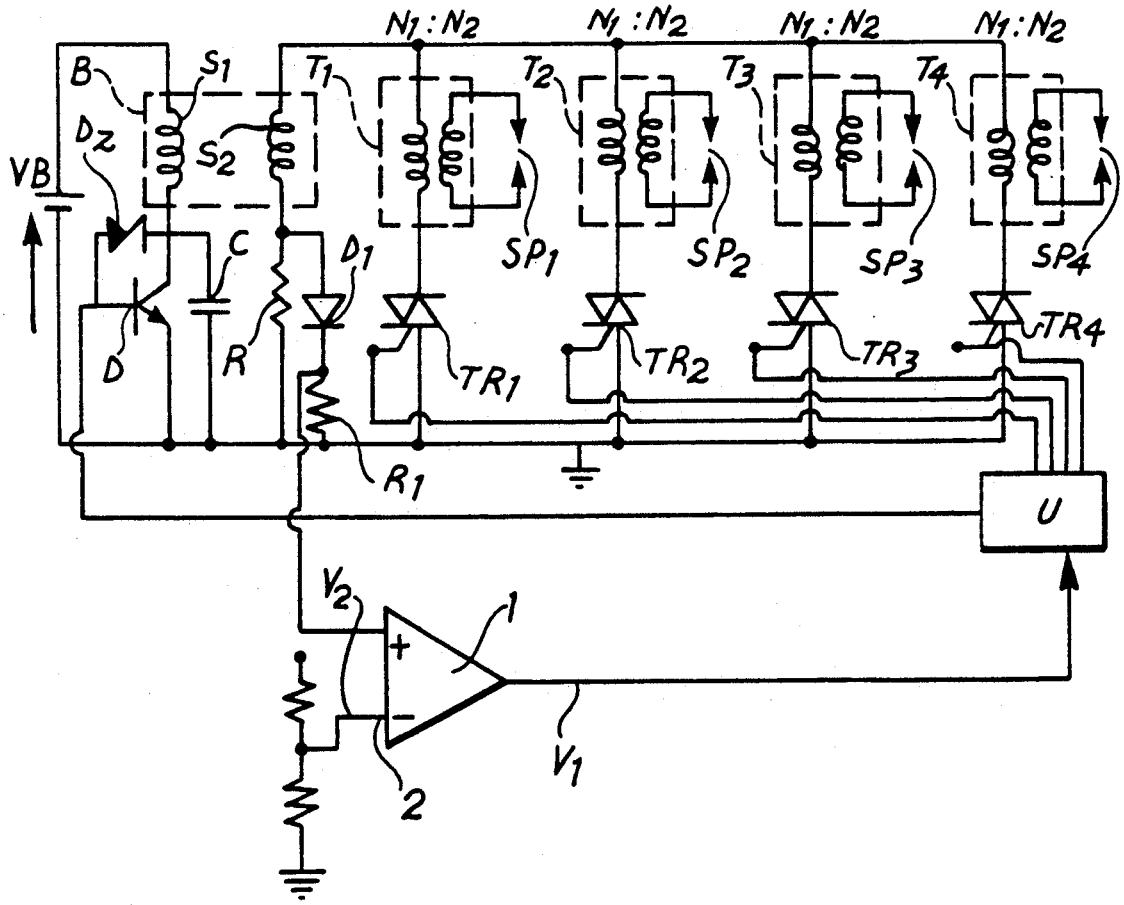
FIG. 3 shows the circuit layout of a device according to the invention.

The circuit diagram of FIG. 3 as a whole represents a generalisation of the diagram of FIG. 1 illustrated with reference to its application to a four-cylinder engine. Four spark plugs SP1, SP2, SP3 and SP4 are therefore present in the engine and each is supplied by a respective voltage step-up transformer (T1, T2, T3 and T4) controlled—according to the criteria already described above—by a respective electronic switch (typically a triac TR1, TR2, TR3 and TR4).

Figure 2:
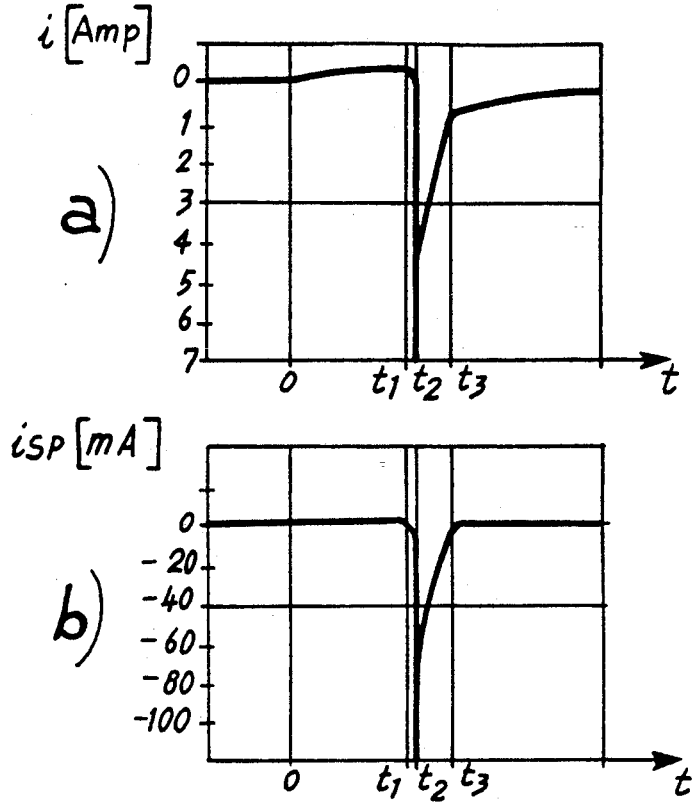

The current i and the arc current $i_{SP}$ corresponding to the spark in each plug will have the typical curves shown in FIG. 2.

Essentially, the present invention is based on the observation that, during the interval t2–t3 (arc duration), if—as indeed is permissible—both the magnetisation current and the current lost in the core are considered negligible, the current i is simply a repetition of the arc current $i_{SP}$ amplified by the ratio of turns in the respective transformer T1, T2, T3 and T4. This is clear from a comparison of the graphs of FIGS. 2*a* and 2*b*.

The presence or absence of this current (which flows through the diode D1) thus establishes with certainty whether or not a spark has been struck in the plug concerned as well as the duration of the arc.

Figure 4:
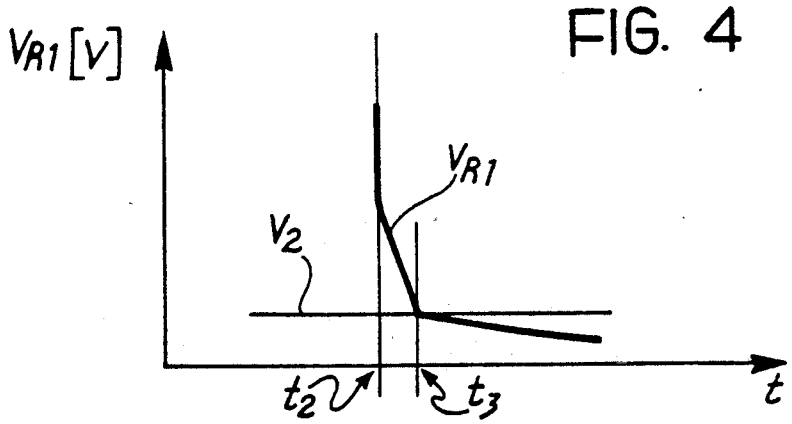
FIGS. 4 and 5 are further time graphs showing the signals present in the device according to the invention.
Figure 5:
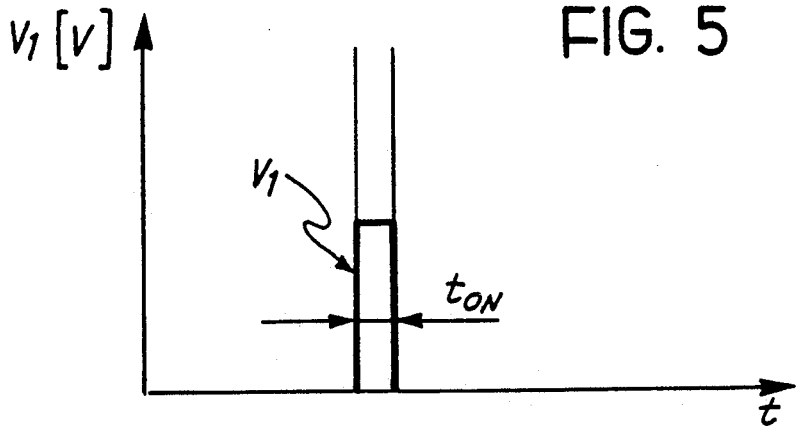

The simplest way to detect this current is to connect a resistor R1 in series with the diode D1 to act as an amperometric detector. The resistor R1 usually has a very low value (for example, 100 milliohms) to limit the voltage drop involved. In the presence of a spark, the voltage across the terminals of the resistor R1 (typically between the terminal connected to the cathode of the diode D1 and the earthing point of the circuit) will thus have the curve shown schematically in FIG. 4.

This drawing shows a graph in which the abscissa is a time scale aligned with the time scales of FIGS. 2*a* and 2*b* and the ordinate is a voltage scale which indicates the behaviour of the voltage $V_r$ across the terminals of the resistor R1.

This voltage can easily be transferred to a comparator circuit (for example, a trigger circuit 1) in order to generate a square-wave output signal V1 whose frequency is equal to that of the firing of the engine. Any "gap" in the output signal of the comparator, which is intended to be transferred to the ignition control unit U, will therefore indicate spark failure and can easily be detected and monitored, possibly with a view to providing an external indication. The control unit U (which is programmed for the purpose according to known principles) can in fact compare the signal output by the comparator 1 with that used to switch on (trigger) the Darlington transistor D and can check that there is an output pulse corresponding to each input trigger pulse and signal externally—as a diagnostic indication of spark failure—the failure of one or more output pulses V1.

This solution achieves effective monitoring without giving rise to any complication of the wiring of the system and without the provision of additional connectors on the control unit. The processing is done in the low-tension circuit without the risk of discharges or other dangerous occurences and without increasing the radio-frequency interference emitted. Above all, the solution is characterised by a low implementation cost.

Moreover, the solution according to the invention lends itself to a further development.

In this connection, it is known that, in order to achieve good combustion, it is necessary to ensure that the arc duration is no shorter than certain characteristic values dictated by the type of engine.

Possible causes of an excessive decrease in the arc duration may be the soiling of the plugs or the need for a higher breakdown voltage (as in the case of supercharged engines operating in over-boost).

The solution described herein enables a good approximate evaluation of the duration of the discharge and hence intervention to increase it if it is critical.

In fact, due to the way in which the waveform has been derived, the duration (ON time) $t_{ON}$ of the signal V1 output by the comparator 1 can easily be made proportional (by a suitable adjustment of the threshold value set at the reference input 2 of the comparator 1) to the spark duration (the duration of the interval t2–t3). A measurement of the duration of this interval (a measurement which can be carried out without difficulty by the central unit U) can thus indicate whether or not the combustion is correct. If the duration of the arc interval is judged insufficient, a method may be provided (also according to known criteria) for increasing the energy stored in the auxiliary coil B by increasing the current flowing in its primary winding. The energy available to the plugs, and hence the duration of the spark, are consequently increased.

Naturally, the principle of the invention remaining the same, the details of embodiment and forms of construction may be varied widely with respect to those described and illustrated, without thereby departing from the scope of the present invention.

What is claimed is:

1. An ignition device for internal combustion engines, comprising:

mutual impedance means with a primary winding and a secondary winding, the secondary winding being intended to supply at least one ignition branch circuit having at least one spark plug, excitation means for storing a given spark energy in the primary winding and transferring the energy rhythmically to the secondary winding, in which the at least one ignition branch circuit includes a respective voltage step-up transformer acting on the secondary winding and the at least one respective spark plug with respective activation means which can selectively cause the transfer of the spark energy to the voltage step-up transformed in order to carry out an ignition cycle, amperometric means sensitive to the intensity of the current flowing through the secondary winding during the transfer of the spark energy to the at least one respective voltage step-up transformer, and detector means connected to the amperometric means for detecting an absence of current flowing through the secondary winding when the spark energy is transferred, an absence of current being indicative of a spark failure, wherein a resistor is interposed between the secondary winding and the at least one ignition branch circuit for limiting the initial prepolarising current in the at least one voltage step-up transformer, a short-circuiting diode being associated with the further resistor for short circuiting the further resistor during the transfer of the spark energy to the voltage step-up transformer, and wherein said amperometric means are arranged electrically in series with said short-circuiting diode.

2. An ignition device for internal combustion engines, comprising:

mutual impedance means with a primary winding and a secondary winding, the secondary winding being intended to supply at least one ignition branch circuit having at least one spark plug, excitation means for storing a given spark energy in the primary winding and transferring the energy rhythmically to the secondary winding, in which the at least one ignition branch circuit includes a respective voltage step-up transformer acting on the secondary winding and the at least one respective spark plug with respective activation means which can selectively cause the transfer of the spark energy to the voltage step-up transformed in order to carry out an ignition cycle, amperometric means sensitive to the intensity of the current flowing through the secondary winding during the transfer of the spark energy to the at least one respective voltage step-up transformer, and detector means connected to the amperometric means for detecting an absence of current flowing through the secondary winding when the spark energy is transferred, an absence of current being indicative of a spark failure, wherein said amperometric means are constituted by a resistor through which the current flows, and said resistor is connected to the secondary winding in series.

3. A circuit according to claim 2 wherein said detector means generate a pulsed signal whose duration is indicative of the duration of the interval during which the spark current is applied to the plugs, and wherein feedback means are associated with the circuit for controlling at least one of the excitation means and the activation means in order to regulate the duration of the interval during which the spark current is applied to the plugs.

4. A device according to claim 2, wherein the ratio between the turns of the primary winding of the mutual impedance means and those of its secondary winding is substantially unitary.

5. A device according to claim 2, wherein said respective activation means activate the respective voltage step-up transformer shortly after the excitation means start to conduct.

6. A device according to claim 2, wherein said detector means comprise a pulse-shaping circuit for converting the amperometric signal supplied by the amperometric means into a pulsed signal, an absence of which is indicative of a spark failure.

7. A device according to claim 6, wherein said pulse-shaping circuit is constituted essentially by a comparator circuit which can compare the amperometric signal supplied by the amperometric means with a threshold level so as to generate a pulsed signal whose duration is indicative of the duration of the interval during which the ignition current is applied to the plugs.

* * * * *